US009598853B1

(12) United States Patent
Vafaee

(10) Patent No.: US 9,598,853 B1
(45) Date of Patent: Mar. 21, 2017

(54) BUILDING WITH CENTRAL CORE

(76) Inventor: Farhad Vafaee, Los Angeles, CA (US)

( * ) Notice: Subject to any disclaimer, the term of this patent is extended or adjusted under 35 U.S.C. 154(b) by 1404 days.

(21) Appl. No.: 13/070,220

(22) Filed: Mar. 23, 2011

Related U.S. Application Data

(63) Continuation-in-part of application No. 12/748,751, filed on Mar. 29, 2010, now Pat. No. 9,441,357.

(51) Int. Cl.
*E04B 1/343* (2006.01)
*E04C 2/52* (2006.01)
*E04B 1/348* (2006.01)

(52) U.S. Cl.
CPC ..... *E04B 1/34336* (2013.01); *E04B 1/34869* (2013.01); *E04C 2/521* (2013.01)

(58) Field of Classification Search
CPC .... E03C 1/01; E04C 2/52; E04C 2/521; E04F 17/08; E04B 1/34336; E04B 1/34869
USPC ..... 52/79.1, 79.9, 79.12, 79.13
See application file for complete search history.

(56) References Cited

U.S. PATENT DOCUMENTS

| | | | | |
|---|---|---|---|---|
| 5,127,201 | A * | 7/1992 | Skvaril | 52/34 |
| 5,528,866 | A * | 6/1996 | Yulkowski | 52/79.12 |
| 7,540,120 | B2 * | 6/2009 | Miller | 52/236.3 |
| 7,779,586 | B2 * | 8/2010 | Stewart et al. | 52/236.3 |
| 2004/0074173 | A1 * | 4/2004 | Miller | 52/234 |
| 2005/0086895 | A1 * | 4/2005 | Elliot et al. | 52/633 |
| 2006/0277838 | A1 * | 12/2006 | Travez et al. | 52/79.1 |
| 2009/0151280 | A1 * | 6/2009 | Jones et al. | 52/236.3 |
| 2009/0165399 | A1 * | 7/2009 | Campos Gines | 52/79.1 |
| 2009/0205264 | A1 * | 8/2009 | Fisher et al. | 52/65 |
| 2009/0293384 | A1 * | 12/2009 | Miller | 52/185 |
| 2009/0307994 | A1 * | 12/2009 | Cathcart et al. | 52/79.9 |
| 2010/0058675 | A1 * | 3/2010 | Simmons | 52/79.1 |
| 2010/0180518 | A1 * | 7/2010 | Postlethwaite | 52/79.1 |

* cited by examiner

*Primary Examiner* — Jessica Laux
(74) *Attorney, Agent, or Firm* — Belasco Jacobs & Townsley, LLP; Norton R. Townsley

(57) ABSTRACT

A building in which a core is attached to a ground floor foundation slab; a roof is attached to the upper end of the core; floors of any desired planar shape are attached to the core at the appropriate heights, intermediate the roof and the ground floor foundation slab; and wall panels are attached between the roof and the ground floor foundation slab around the periphery of the building. Also, the floors and roof are attached to the wall panels. The core is preferably as claimed and described in U.S. patent application Ser. No. 12/748,751 and may be attached to one side of the ground floor foundation slab. The floors may extend the entire length and/or width of the building or only a portion of the length and/or width. If they do not extend the entire length and/or width of the building, the free ends of the floors are supported by a cross beam that attaches to the walls on either side or a support wall or beam that extends to the floor below or the ground floor slab, or any other suitable method for support.

10 Claims, 7 Drawing Sheets

BUILDING WITH CENTRAL CORE

CROSS REFERENCE

This application is a continuation in part of U.S. patent application Ser. No. 12/748,751, filed Mar. 29, 2010 now U.S. Pat. No. 9,441,357, the entire specification, claims and drawings of which are hereby incorporated by reference.

BACKGROUND OF THE INVENTION (1) Field of the Invention

The present invention relates to the field of building construction and more particularly to the field of prefabricated building construction.

(2) Description of the Related Art

Currently, houses are built in a standard sequence. The following is a typical sequence.

Grading and site preparation

Construction of foundation. Typically premixed concrete is poured or pumped into molds constructed on the site.

Erection of framing on the foundation. Wood and steel are usually used for framing members. Openings are left in the framing for placement of doors and windows.

Installation of windows and doors.

Construction of roofing on top of the framing.

Installation of exterior walls and/or siding.

Installation of rough electrical wiring.

Installation of rough plumbing.

Installation of rough heating, ventilation and air conditioning (HVAC).

Installation of alarm system wiring.

Installation of phone system wiring.

Installation of local area network LAN wiring.

Installation of insulation in exterior walls and attic.

Attachment of drywall to interior of framing.

Installation of underlayment for floors.

Installation of trim

Painting.

Installation of finish electrical, such as switches and lights.

Installation of finish alarm system.

Installation of LAN and phone system jacks and cover plates.

Installation of bathroom and kitchen counters and cabinets

Installation of finish plumbing, such as sinks, toilets and faucets.

Installation of carpet and other flooring.

Installation of HVAC units.

Hookup to water main or well.

Hookup to sewer or septic system

Correction of problems.

Homes are built to the current standards and government codes and with the latest available amenities. But such construction does not allow for adaptability and installation of new technology. For example, demolition and reconstruction are required if the homeowner wishes to upgrade the existing home's layout and fixtures, or they wish to upgrade the infrastructure (plumbing, electrical, communications, etc.). Since the home's infrastructure is so integrated into the superstructure, it is nearly impossible to simply rearrange spaces without also reconfiguring the main systems of the house as well.

Another problem with typical home construction is that it takes a long time. Usually the foundation is poured quickly and the framing is built very fast but after that it takes a long time to for all the subcontractors to install the electrical, plumbing, etc.

A number of inventors have attempted to solve one or other of these problems.

(1) U.S. Pat. No. 4,447,996

This Patent is directed to prefabricated building structures for use in buildings with multiple units. The building will have modules to accept cubicles that are factory built containing an entire bathroom complete with lavatory, bathtub, water closet, and their associated plumbing, electrical wiring, outlets, exhaust fan and the like. The module likewise could be a complete kitchen with appliance, wiring and the like. The prefabricated module that receives the cubicle can be placed to form the building by means of a crane and if the crane is of sufficient capacity the prefabricated cubicle could be positioned in the module and both installed at the same time. The cubicle will have one wall that is an exterior wall so that at a time to upgrade or repair a fire damaged unit a refurbished or new unit can be brought on site and the old one removed with the aid of rollers so that it can be rolled out to the crane. It would also be possible to change the type of cubicle from for instance kitchen to bathroom or bathroom to kitchen.

(2) U.S. Pat. No. 6,301,838

This Patent is directed to building modules that can be prefabricated and installed in a building structure complete. The first building module is shown in FIG. 1 is for one bathroom and the larger module shown in FIG. 6 is for two rooms, electrical junction boxes and supply lines to light fan outlets and other fixtures conveniently extended within the module making it convenient and easy to connect the module to the electrical supply lines. Likewise with the dryer vent, hot and cold water lines, gas conduit and the waste lines. The toilets are off the floor water closet. The rooms preferably toilets with lavatory or wash basins, bath and shower may otherwise be laundry rooms, kitchens, custodian rooms, rest rooms, or other kinds of rooms requiring one or more waste conduits to carry away waste water and likely require cold water and electricity and possibly hot water. Such rooms may further require gas dryer vents and other lines or conduits.

(3) U.S. Pat. No. 5,528,866

This Patent is directed to a method and apparatus' for constructing multi-rise stacked modules for human occupancy. The construction is in a pinwheel array with the method of construction providing for individual models that may be readily positioned and removed without affecting the structural integrity of the multi-rise structure. The modules are prefabricated, electrical and water services may be provided through hookups to a vertically extending electrical and water surface panels supported about a central open core. The dwelling modules could encompass habitat for residence, office, manufacture, or other human uses.

(4) U.S. Pat. No. 7,540,120

This patent is directed to a multi-level apartment building that includes a vertically extending stairway system with support walls that contain rectilinearly vertically extending utility service conduits used to receive standard utility services such as HVAC, plumbing, exhaust, etc. that extend in vertical straight line paths in the building thus the single stair support assembly vertically extending in each of the plurality of vertically aligned apartments function to consolidate plumbing, HVAC and other utilities into a single assembly having a straight vertical and unobstructed path. The apartment modules preferably includes a plurality of pairs of apartments vertically stacked in alternating mirrored patterns and a plurality of such vertically stacked pairs of apartments horizontally aligned with one another.

(5) U.S. Pre-Grant Publication 2009/0031642

This reference is directed to interactive building modules that move between a collapsed configuration which is sized and shaped similarly to a standard shipping container that can be erected where it forms a building of greater space. The modules are connected together to form a single storied or multi-storied building. A series of standardized ceiling panels located within the common area create accessible services duct for placement of hydraulic, electrical, and that illumes. Hot water is distributed to each module via a continuous hot water loom. A network managing system interactively manages resources. Scenarios for use of modules are virtual space, serviced office, hotel or serviced apartment or residential uses. The scenarios are not mutually exclusive. The design principle enables the same space to be used for different uses over time. The transference of a module from one use to another beside changing the furniture possibly the reprogramming or alternation of certain services to suit the requirements of the occupant and the new use of the module. The internal fit-out may consist of a range of standard plug-in modular components providing a variety of function and form.

(6) U.S. Pat. No. 4,327,529

This reference is directed to a prefabricated building comprising: a plurality of exterior and interior wall sections joined together in a selected configuration; a plurality of ceiling panels extending between the walls; a plurality of roof trusses overlying the ceiling panels; a roof supported by the trusses; a prefabricated utility core comprising: a plurality of vertical connected core walls extending vertically, one of the core walls providing an exterior wall of the building, an access door in this exterior wall, a main sewer line supported in the core and extending through the exterior core wall and having a plurality of lateral sewer lines extending through the core walls, a main water line extending through the exterior core wall and supported in the core and having a plurality of lateral water lines extending through the core walls, a water heater in the core connected to the main water line, a main hot water line connected to the heater and having a plurality of lateral hot water lines extending through the core walls, a breaker box in the core, a plurality of electrical conduits extending from the breaker box; and fixtures utilizing water and discharging sewage connected to selected the appropriate lateral lines.

(7) U.S. Pat. No. 4,655,011

This reference is directed to a prefabricated building system comprising a portable wall unit having a supporting frame and utility apparatus mounted on the supporting frame. The utility apparatus preferably is adjustably mounted on the supporting frame and may comprise plumbing, electrical, heating and/or cooling apparatus for the rooms adjacent to the portable wall unit in the building in which it is to be installed. Prefabricated wall partitions for the adjacent rooms can be assembled with the portable wall unit before shipment to the building site or at the building site. The portable wall unit is provided with means for aligning the wall unit with the adjacent wall partitions to facilitate the assembly thereof.

(8) U.S. Pat. No. 5,127,201

This reference is directed to a compact service core structure. The walls of the prefabricated compact service core structure are higher than the total height of the floor, wall and ceiling structure of an ordinary one-storey residential building, but lower than the total height of a two-storey building of any kind. The height of the walls is large enough to e.g. accommodate the serviced fixtures of complete main floor bathroom, kitchen, and possibly laundry and utility rooms, as well as lower parts of the same rooms of the second storey of a two-storey structure. On the other hand, the height is small enough to make the prefabricated compact service core structure possible to ship on standard low trailers anywhere in the world. The prefabricated compact service core structure allows for factory completion of all major plumbing, heating, ventilation, and electrical work for a two-storey building, and easy on site hook-up to sewer, water, gas and electrical services from the bottom of the prefabricated compact service core structure ventilation and possibly electrical services may be extended above the top of the core through one or more extension service panels. As all portions of the floor of both storeys and high plumbing wall are suspended, pre-manufacturing of the service core in the plan can easily match all custom designed floor heights or deviations from them usually originating from the supply of building lumber of irregular dimensions.

(9) U.S. Pat. No. 5,890,341

This reference is directed to a modular structure consisting of three modular units of approximately the same size, the center module being the primary module containing the mechanical components of the building, with plumbing, air conditioning and heating ducts, and electrical wiring in the slab floor structural foundation and door jambs. The primary module used to transport the entire structure is completed at the factory, requiring no further work at jobsite, with heating and cooling unit, hot water heater, cabinets and appliances, plumbing and light fixtures and accessories installed at the factory in permanent locations. The major exterior walls, slab floor foundation panels, and ceiling/roof panels for all three modules are similarly manufactured in one piece in full width and the length of the building, eliminating joints, speeding assembly and strengthening the components. The major components of the side modules, consisting of the slab floor foundation panels, ceiling/roof panels and the exterior side walls, are all hinged so that they fold to the side and on top of the primary module. Accessories and wall panels and partitions not hinged are placed on top of the primary module for transportation. Two end walls are bolted to the center module during transportation to the site. At the pre-leveled permanent site, the primary module is lowered to the ground and the hinged slab floor foundation panels, which include hinged and folded exterior walls, along with the ceiling/roof panels, are unfolded and permanently fastened in place for that site, but can be refolded if later relocation is needed. The slab floor foundation panels for all three modules are placed directly on the ground or on a pre-built foundation, single or multi-level design. If a pitched roof was ordered, trusses and pre-sized roofing panels transported on top of the primary module are attached to the flat roof of the center module. Two or more of these triple modules can be joined side-to-side or end-to-end or on top of each other, for erection of multiple-unit buildings.

However, none of these inventions allow a house to be built without waiting for installation of services and none of these inventions allow for ease of maintenance or avoidance of damage during remodeling and renovations.

What is needed is a way of allowing a house to be built without waiting for installation of services and which, when built, would be easy to maintain and remodel.

Development of a way to allow houses to be built without waiting for installation of services and which, when built, would be easy to maintain and remodel represents a great improvement in the field of construction and satisfies a long felt need of the contractor and homeowner.

SUMMARY OF THE INVENTION

The present invention is a building in which a core is attached to a ground floor foundation slab; a roof is attached to the upper end of the core; floors of any desired planar shape are attached to the core at the appropriate heights, intermediate the roof and the ground floor foundation slab; and wall panels are attached between the roof and the ground floor foundation slab around the periphery of the building. Also, the floors and roof are attached to the wall panels.

First the ground floor foundation slab is poured. The core may be built on site or, preferably, built off site and delivered to the building site. The core is attached to the ground floor foundation slab. A roof of suitable pitch, is constructed and attached to the upper end of the core. Floors of any desired planar shape are constructed and attached to the core intermediate the roof and the ground floor foundation slab. Wall panels are constructed and installed around the periphery of the building between the roof and the ground floor foundation slab. The walls are also attached to the wall panels.

The core is preferably as claimed and described in U.S. patent application Ser. No. 12/748,751 and may be attached to one side of the ground floor foundation slab.

The floors may extend the entire length and/or width of the building or only a portion of the length and/or width. If they do not extend the entire length and/or width of the building, the free ends of the floors are supported by a cross beam that attaches to the walls on either side or a support wall or beam that extends to the floor below or the ground floor slab, or any other suitable method for support.

An appreciation of the other aims and objectives of the present invention and an understanding of it may be achieved by referring to the accompanying drawings and description of a preferred embodiment.

BRIEF DESCRIPTION OF THE DRAWINGS

FIG. 1 shows the house from one side. Walls, windows and doors have been omitted for clarity.

FIG. 2 shows the house from the other side. Walls, windows and doors have been omitted for clarity.

FIG. 3 is the same as FIG. 1 except that one exterior wall panel is included for illustrative purposes and the structure under one floor is partially visible.

DETAILED DESCRIPTION OF THE PREFERRED EMBODIMENT

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
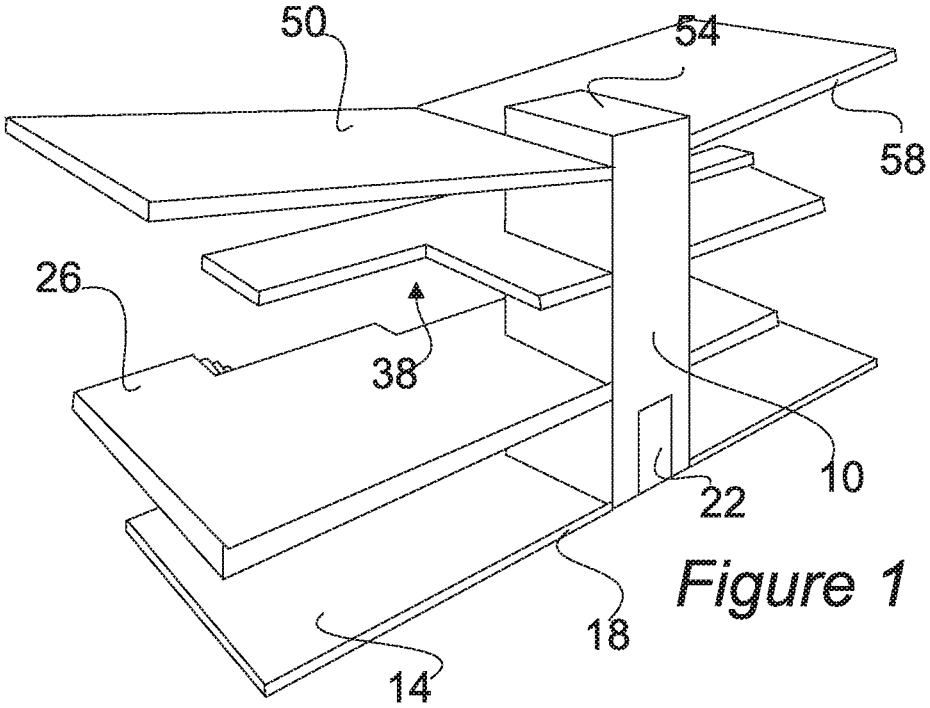
FIGS. 1-3 illustrate how a house in accordance with this invention is built.
Figure 2:
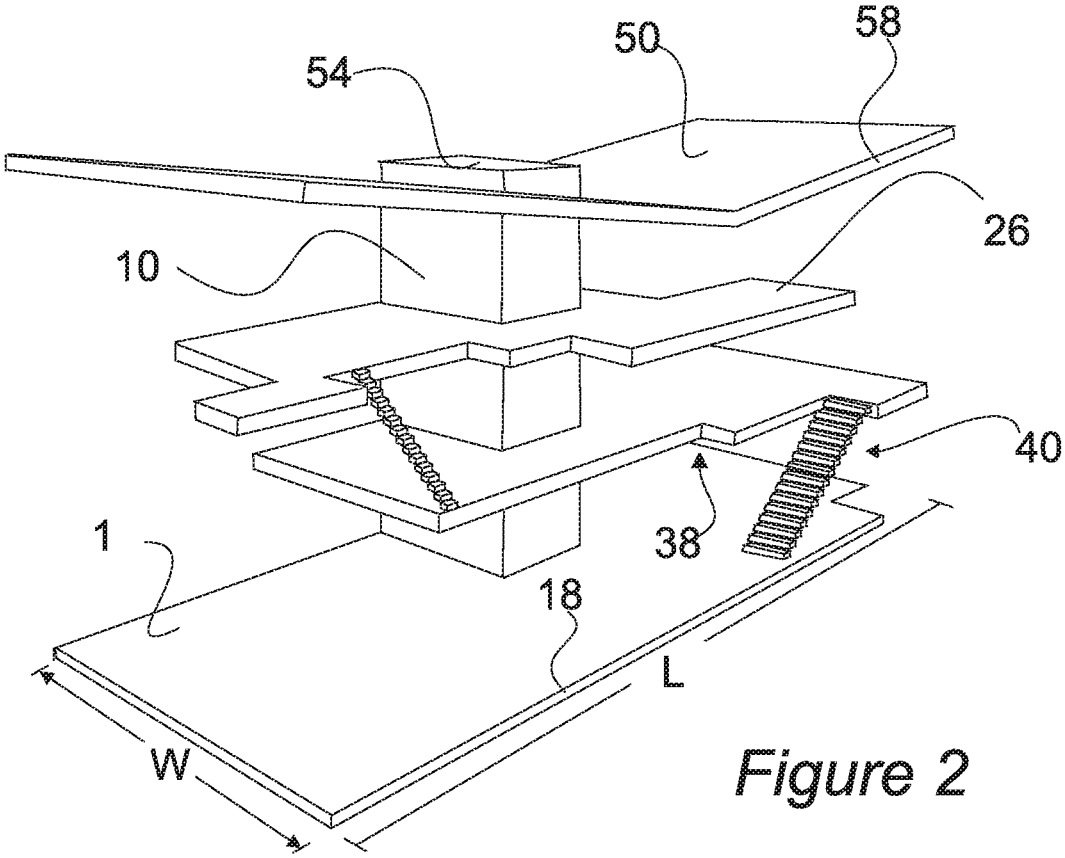
Figure 3:
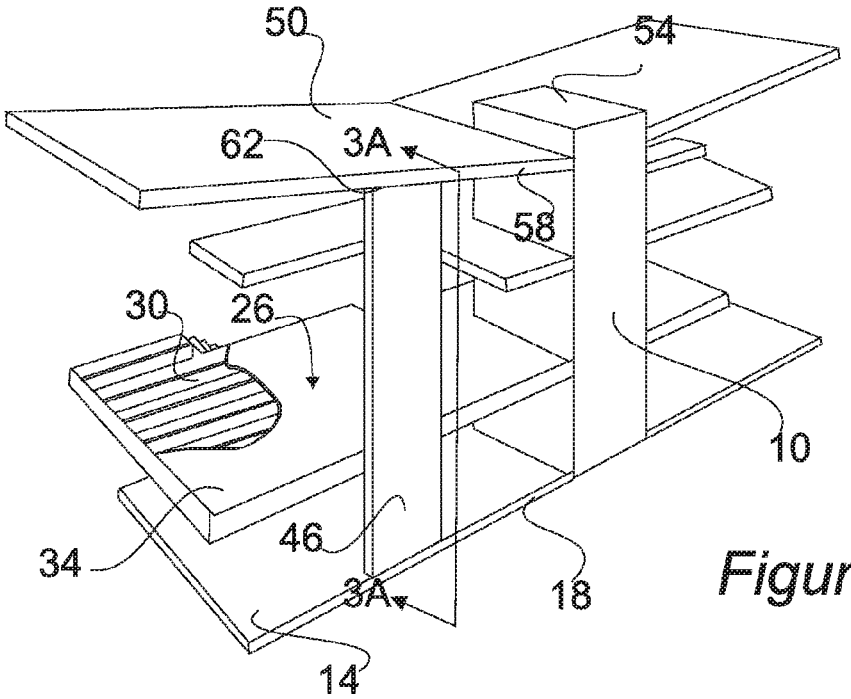

FIGS. 1-3 illustrate how a house in accordance with this invention is built. As can be seen, a core 10, preferably manufactured in accordance with co-pending U.S. patent application Ser. No. 12/748,751, is attached to a foundation slab 14. The preferred method of attachment is illustrated at FIG. 5A and paras. [0145] and [0146] of the '751 application. Preferably, the core 10 is attached at one side 18 of the slab 10. In this way, the access door 22 to the core 10 is accessible from the outside. However, the core 10 can be fastened anywhere within the confines of the foundation slab 14.

One or more floors 26 are attached to the core 10 at the appropriate heights. The floors 26 are constructed of conventional joist 30 and subfloor 34 construction and can be of any planar shape. As illustrated in the Figures, the floors 26 can extend the full length L and/or and width W of the building, or can extend for only a portion of the length L and/or and width W of the building.

Figure 7:
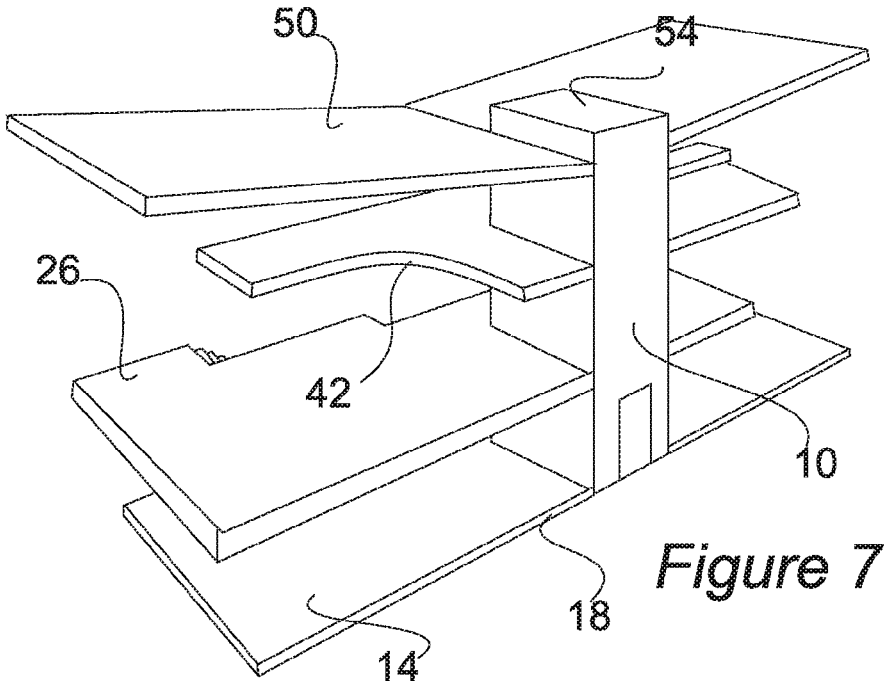
FIG. 7 is similar to FIG. 1 except some floor edges are curved.
Figure 8:
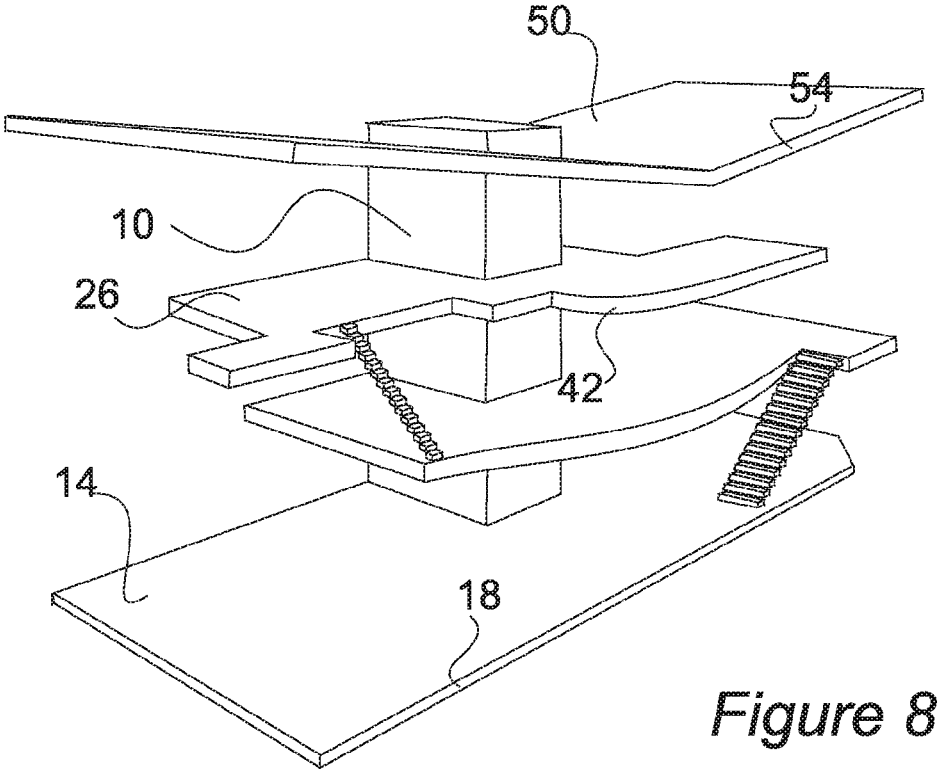
FIG. 8 is similar to FIG. 2 except some floor edges are curved.

The floors 26 can also include dog leg cut outs 38, some of which will be for stairways 40. Moreover, the floors 26 can even have curved edges 42 as illustrated in FIGS. 7 and 8. The preferred method of attachment of the floors 26 to the core 10 is shown at FIG. 5B and para. [0149] of the '751 application. The floors 26 are also attached to wall panels 46 in a similar manner. In this way the floors 26 are supported by the structure of the core 10 and the structure of the wall panels 46.

Figure 4:
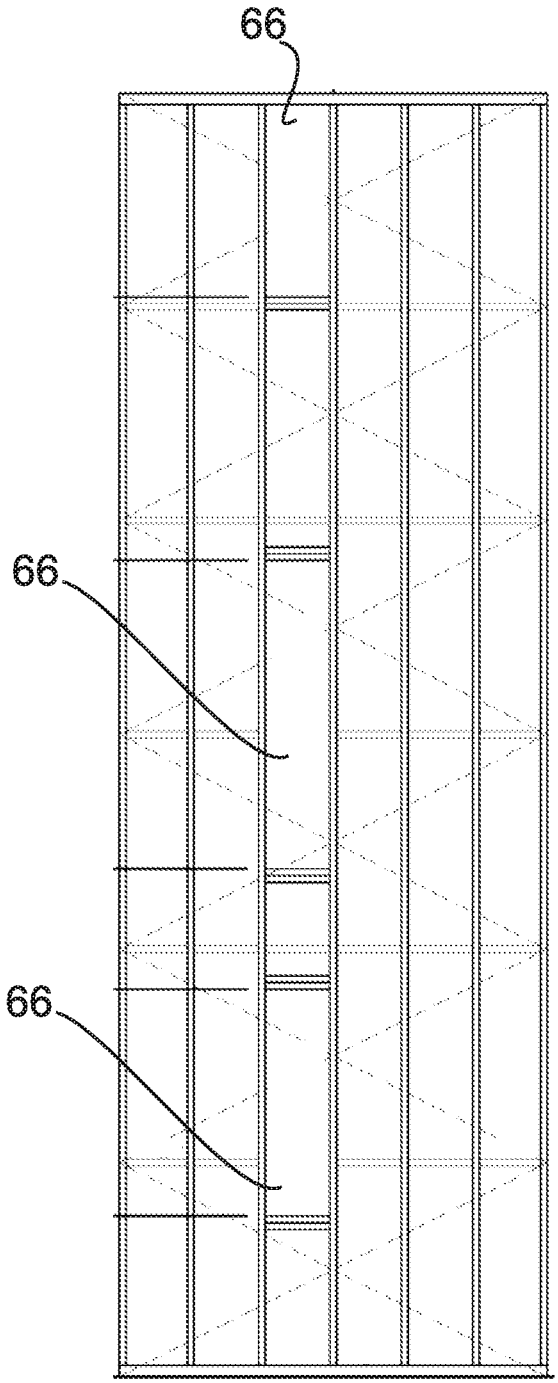
FIG. 4 shows the framing for one type of exterior wall panel.
Figure 5:
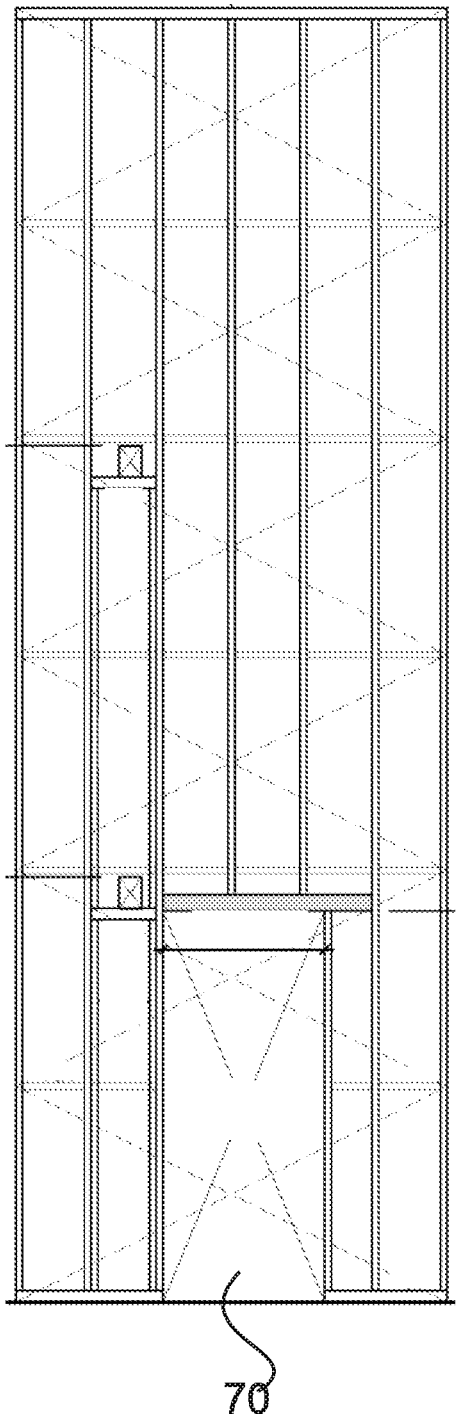
FIG. 5 shows the framing for another type of exterior wall panel.
Figure 6:
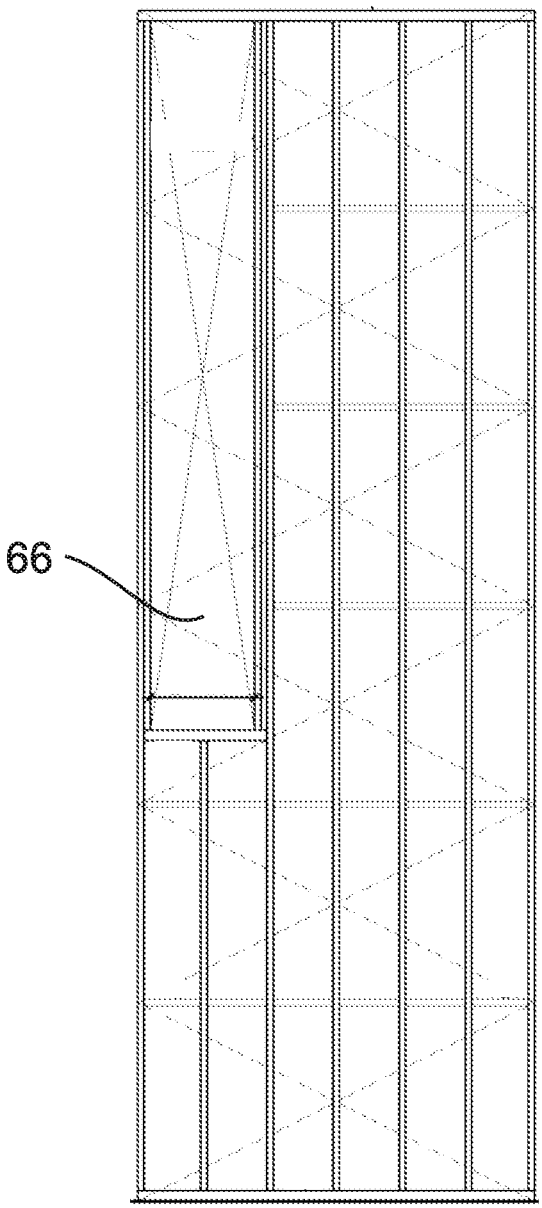
FIG. 6 shows the framing for yet another type of exterior wall panel.

While only one wall panel 46 is shown in FIG. 3, it will be understood by those most familiar with the art to which this invention pertains that multiple wall panels 46 will be installed around the exterior of the building. Several different kinds of framing schemes for the wall panels 46 are shown in FIGS. 4, 5 and 6. Window 66 and door 70 openings can be seen in the framing.

A roof 50 is attached near the top 54 of the core 10. The roof 50 is preferably constructed of conventional joists similar to that of the floors and has a pitch sufficient to effectively shed rain water, snow and ice. Of course, the top layer is some sort of waterproof membrane. The edges 58 of the roof 50 are attached over the tops 62 of the wall panels 46. In this way the roof 50, too, is supported by the structure of the core 10 and the structure of the wall panels 46.

Figure 3A:
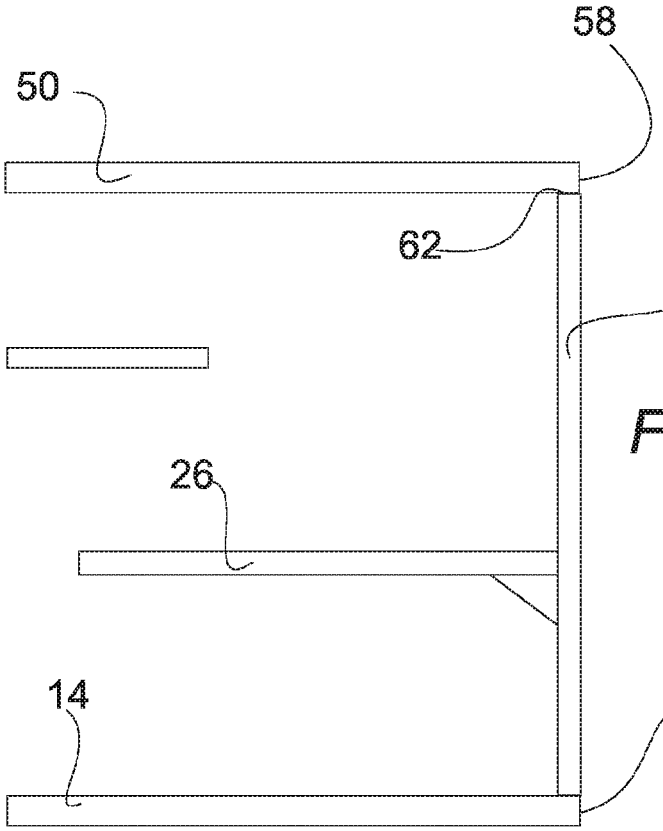
FIG. 3A is a cross section along the lines 3A-3A of FIG. 3.

FIG. 3A illustrates in better detail the support relationships of the roof 50, floors and wall panels 46. The wall panel 46 is a bearing wall. As such it can support the weight of the roof 50, and the weight of attached flooring 26 in conjunction with the core 10 to which they are also attached.

Figure 9:
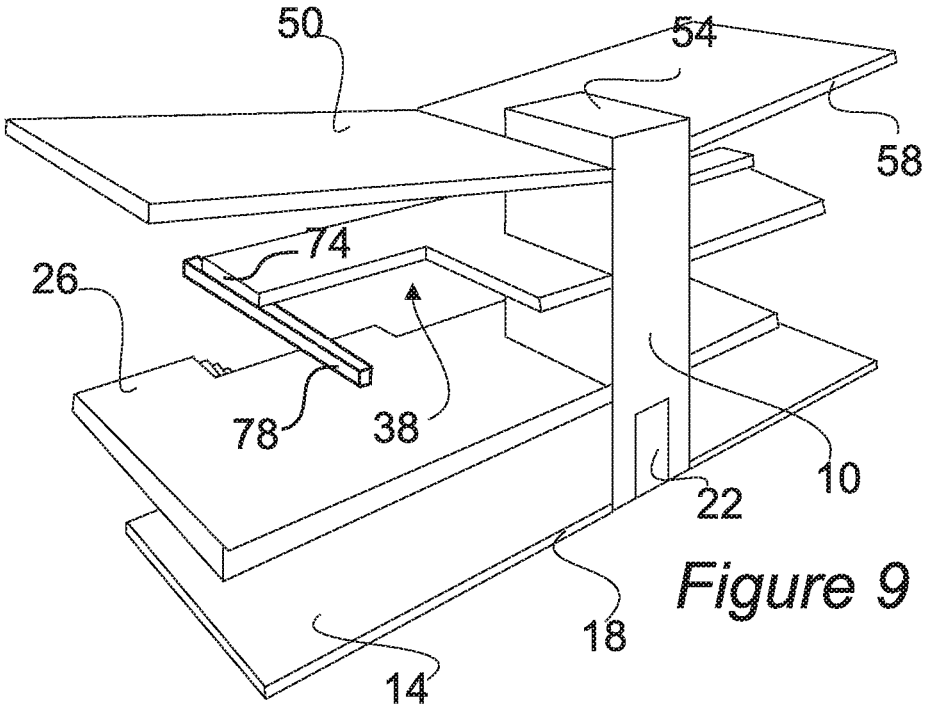
FIG. 9 illustrates how a free end of a floor can be supported by a cross beam.
Figure 10:
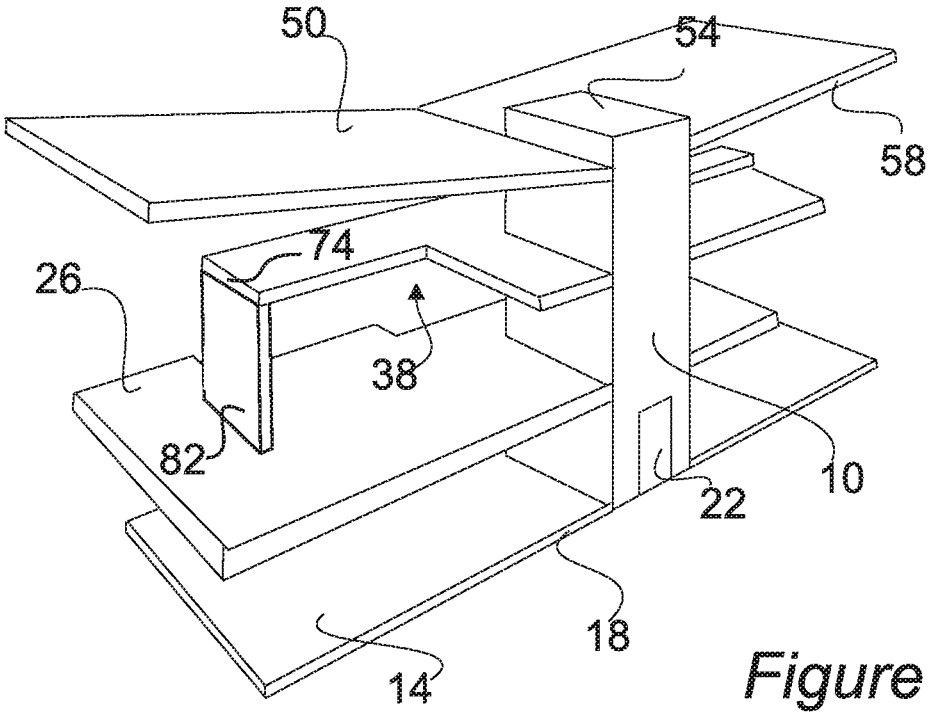
FIG. 10 illustrates how a free end of a floor can be supported by a bearing wall.

If the floors do not extend all the way from exterior wall 46 to exterior wall 46 their free or unsupported ends 74 can be supported by a beam 78 which does run from wall 46 to wall 46 and is attached to each wall. See FIG. 9

Alternatively, the free end 74 can be supported by a bearing wall or column 82 which runs at least to the floor 26 below or the foundation slab 14

The following reference numerals are used on FIG. 1 through . . . :

10 core, preferably manufactured in accordance with co-pending U.S. patent application Ser. No. 12/748,751
14 foundation slab
18 side of slab
22 access door

26 floor
30 joist
34 subfloor
38 dog let cut out
40 stairway
42 curved edge
46 wall panel
50 roof
54 top of core
58 edge of roof
62 top of wall panel
66 window opening
70 door opening
74 free end of floor
78 beam
82 bearing wall or column Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A building comprising:

a) a ground floor foundation slab b) a core, having an upper end, attached to said ground floor foundation slab; said core comprising:

i) an exterior wall section and three interior wall sections joined together to form a room; said interior and exterior wall sections being at least two storeys tall; each of said wall sections having a top, an inside and an outside; said interior wall sections being shear walls; the outsides of said interior wall sections being finished with an interior finish; the outside of said exterior wall section being finished with an exterior finish;

ii) a structural hold down attached to said room, within said room, at each corner;

iii) an interior platform attached to the inside of at least one of said walls;

iv) a means for attaching an external floor, external to said room, to each of said interior walls;

v) an access door in said exterior wall; said access door being sized for ingress and egress to said room for a person in full upright position;

vi) a fresh air louver within said exterior wall;

vii) a water main connection located outside said exterior wall section;

viii) a gas main connection located outside said exterior wall section;

ix) a sewer connection located inside said room;

x) a water heater appliance in said room;

xi) a clothes washer connection located adjacent and outside of one of said interior wall sections;

xii) a drier connection located adjacent and outside of one of said interior wall sections;

xiii) a dishwasher connection located adjacent and outside of one of said interior wall sections;

xiv) a toilet mechanism appliance located within at least one of said interior wall sections; said mechanism installed so that the bowl for said toilet will install from outside of said room;

xv) a faucet appliance attached to said outside of at least one of said interior wall sections;

xvi) a mixing valve appliance attached to said outside of at least one of said interior wall sections;

xvii) plumbing and shut off valves interconnecting said water main connection, gas main connection, sewer connection, water heater, clothes washer connection, drier connection, dishwasher connection, toilet mechanism, faucet and mixing valve, as necessary and appropriate; said shut off valves being located adjacent the insides of said interior walls as close as possible to said appliances and said interior connections;

xviii) an irrigation connection connected to said water main and located outside said exterior wall section;

xix) an electric mains connection located on said exterior of said exterior wall section;

xx) a breaker box located within said room and electrically connected to said electric mains connection;

xxi) a forced air unit within said room;

xxii) an air conditioning condenser unit within said room, connected by ducting within said room to said forced air unit and located near said fresh air louver, whereby hot air produced by said air conditioning condenser unit can escape through said louver;

xxiii) a return air duct stub connected to said forced air unit and running through one of said interior wall sections;

xxiv) a supply air duct stub connected to said forced air unit and running through one of said interior walls;

xxv) a phone line connection located outside said exterior wall section;

xxvi) a television signal connection located outside said exterior wall section;

xxvii) a telephone punch block located inside said room and electrically connected to said phone line connection;

xxviii) a signal splitter located inside said room and electrically connected to said television signal connection;

xxix) a modem inside said room and electrically connected to one of said telephone punch block via a DSL line and said signal splitter;

xxx) a security panel inside said room, electrically connected to one of said telephone punch block and said modem;

xxxi) a fire suppression unit within said room connected by a plumbing line to said water main connection;

xxxii) a sprinkler line stub running from said fire suppression unit through an interior wall of said room;

xxxiii) an exhaust fan within said room;

xxxiv) an inlet duct running through an interior wall of said room to said exhaust fan;

xxxv) an outlet duct running from said fan to said fresh air louver;

xxxvi) an exhaust fan control switch attached to the outside of at least one of said interior wall sections and electrically connected to said exhaust fan;

xxxvii) a drier vent running from behind the eventual location of said clothes drier through said interior wall through said room and through said exterior wall;

xxxviii) a range hood attached to a the inside outside of one of said interior walls over the eventual location of said range;

xxxix) a range exhaust fan in said room;

xl) range hood inlet ducting connecting said range hood to said range exhaust fan;

xli) range exhaust ducting running from said range exhaust fan to said fresh air louver;

xlii) control wiring running from the switch in said range hood to said range exhaust fan;

xliii) a core exhaust fan located in said room adjacent said fresh air vent; and xliv) a thermostatic control inside said room and electrically connected to said core exhaust fan;

xlv) said room being sized to contain all the above listed equipment, and allow for access to, repair of and replacement of said equipment by a person;

c) a roof of suitable pitch attached to said upper end of said core;

d) a floor of any desired planar shape attached to said core intermediate said roof and said ground floor foundation slab;

e) a wall panel attached between said roof and said ground floor foundation slab;

said floor being also attached to said wall panel.

2. A building as claimed in claim 1 in which said core is attached to one side of said ground floor foundation slab.

3. A building as claimed in claim 1 in which said floor has a free end, and said building further comprises a means for supporting said free end.

4. A building as claimed in claim 3 in which said means for supporting is a cross beam attached to said wall panel.

5. A building as claimed in claim 3 in which said means for supporting is a support wall extending to either of a floor below and said ground floor slab.

6. A method of constructing a building comprising the steps of:

a) pouring a ground floor foundation slab b) obtaining a core, having an upper end; fabrication of said core comprising the steps of:

i) fabricating a room having an exterior wall section and three interior wall sections; said interior and exterior wall sections being at least two storeys tall; each of said wall sections having a top, an inside and an outside; said interior wall sections being shear walls; the outsides of said interior wall sections being finished with an interior finish; the outside of said exterior wall section being finished with an exterior finish;

ii) attaching a structural hold down to said room, within said room, at each corner;

iii) constructing an interior platform attached to the inside of at least one of said walls;

iv) fabricating a means for attaching an external floor, external to said room, to each of said interior walls;

v) installing an access door in said exterior wall; said access door being sized for ingress and egress to said room for a person in full upright position;

vi) installing a fresh air louver within said exterior wall;

vii) installing a water main connection outside said exterior wall section;

viii) installing a gas main connection outside said exterior wall section;

ix) installing a sewer connection inside said room;

x) installing a water heater appliance in said core;

xi) installing a clothes washer connection adjacent and outside of one of said interior wall sections;

xii) installing a drier connection adjacent and outside of one of said interior wall sections;

xiii) installing a dishwasher connection adjacent and outside of one of said interior wall sections;

xiv) installing a toilet mechanism appliance located at least one of said interior wall sections; said mechanism installed so that the bowl for said toilet will install from outside of said room;

xv) attaching a faucet appliance to said outside of at least one of said interior wall sections;

xvi) attaching a mixing valve appliance to said outside of at least one of said interior wall sections;

xvii) installing plumbing and shut off valves interconnecting said water main connection, gas main connection, sewer connection, water heater, clothes washer connection, drier connection, dishwasher connection, toilet mechanism, faucet and mixing valve as necessary and appropriate; said shut off valves being located adjacent the insides of said interior walls as close as possible to said appliances and said interior connections;

xviii) installing an irrigation connection to said water main and outside said exterior wall section;

xix) installing an electric mains connection on said exterior of said exterior wall section;

xx) installing a breaker box within said room and electrically connected to said electric mains connection;

xxi) installing a forced air unit within said room;

xxii) installing an air conditioning condenser unit within said room, near said fresh air louver; whereby hot air produced by said air conditioning condenser unit can escape through said louver;

xxiii) connecting said air conditioning condenser by ducting within said room to said forced air unit;

xxiv) connecting a return air duct stub to said forced air unit through one of said interior wall sections;

xxv) connecting a supply air duct stub to said forced air unit through one of said interior walls;

xxvi) installing a phone line connection outside said exterior wall section;

xxvii) connecting a television signal connection outside said exterior wall section;

xxviii) installing a telephone punch block inside said room;

xxix) electrically connecting said phone line to said punch block;

xxx) installing a signal splitter inside said room;

xxxi) electrically connecting said television signal connection to said signal splitter;

xxxii) installing a modem inside said room;

xxxiii) electrically connecting said modem to one of said telephone punch block via a DSL line and said signal splitter;

xxxiv) installing a security panel inside said room;

xxxv) electrically connecting said security panel to one of said telephone punch block and said modem;

xxxvi) installing a fire suppression unit within said room;

xxxvii) connecting said fire suppression unit by a plumbing line to said water main connection;

xxxviii) installing a sprinkler line stub running from said fire suppression unit through an interior wall of said room;

xxxix) installing an exhaust fan within said room;

xl) connecting an inlet duct through an interior wall of said room to said exhaust fan;

xli) connecting an outlet duct from said fan to said fresh air louver;

xlii) installing an exhaust fan control switch to the outside of at least one of said interior wall sections;

xliii) electrically connecting said exhaust fan control switch to said exhaust fan;

xliv) installing a drier vent from behind the eventual location of said clothes drier through said interior wall through said room and through said exterior wall;

xlv) attaching a range hood to a the inside of one of said interior walls over the eventual location of said range;

xlvi) installing a range exhaust fan in said room;

xlvii) connecting said range hood to said range exhaust fan with ducting;

xlviii) installing range exhaust ducting from said range exhaust fan to said fresh air louver;

xlix) installing control wiring from the switch in said range hood to said range exhaust fan;

l) installing a core exhaust fan in said room adjacent said fresh air vent;

li) installing a thermostatic control inside said room; and lii) electrically connecting said thermostatic control to said room exhaust fan;

liii) said room being sized to contain all the above listed equipment, and allow for access to, repair of and replacement of said equipment by a person;

c) attaching said core to said ground floor foundation slab;

d) constructing a roof of suitable pitch, attached to said upper end of said core;

e) constructing a floor of any desired planar shape attached to said core intermediate said roof and said ground floor foundation slab;

f) constructing a wall panel attached between said roof and said ground floor foundation slab; and g) attaching said floor to said wall panel.

7. A method as claimed in claim 6 in which said floor has a free end and said method further comprises the steps of:

a) providing a means for supporting; and b) attaching said free end to said means for supporting.

8. A method as claimed in claim 7 in which said means for supporting is a cross beam and further comprising the step of attaching said cross beam to said wall panel.

9. A method as claimed in claim 7 in which said means for supporting is a support wall extending to a floor below or said ground floor slab.

10. A method as claimed in claim 6 in which said core is attached to one side of said ground floor foundation slab.

* * * * *